US008215539B2

(12) United States Patent
Stonehouse

(10) Patent No.: US 8,215,539 B2
(45) Date of Patent: Jul. 10, 2012

(54) FOOD CONTAINER

(75) Inventor: Donald B. Stonehouse, Dayton, OH (US)

(73) Assignee: Burrows Paper Corporation, Little Falls, NY (US)

( * ) Notice: Subject to any disclaimer, the term of this patent is extended or adjusted under 35 U.S.C. 154(b) by 325 days.

(21) Appl. No.: 12/564,786

(22) Filed: Sep. 22, 2009

(65) Prior Publication Data

US 2010/0072266 A1 Mar. 25, 2010

Related U.S. Application Data

(60) Provisional application No. 61/099,071, filed on Sep. 22, 2008.

(51) Int. Cl.
*B65D 5/355* (2006.01)

(52) U.S. Cl. ..... 229/101; 229/103; 229/114; 229/146; 229/902; 294/172

(58) Field of Classification Search ..... 229/101, 229/103, 114, 146, 902, 906, 938; 294/137, 294/172; 426/115
See application file for complete search history.

(56) References Cited

U.S. PATENT DOCUMENTS 970,480 A * 9/1910 Eddy ..... 229/101
3,391,782 A * 7/1968 Kaspar ..... 426/115
3,446,416 A * 5/1969 Epstein ..... 229/938
3,983,256 A * 9/1976 Norris et al. ..... 426/115
4,136,817 A * 1/1979 Perry ..... 229/101
4,189,054 A * 2/1980 Liu et al. ..... 229/938
4,585,124 A * 4/1986 Pride ..... 426/115
4,641,752 A * 2/1987 Palffy ..... 426/115
4,791,883 A * 12/1988 Lehman et al. ..... 229/146
5,071,062 A * 12/1991 Bradley et al. ..... 229/103
5,115,524 A * 5/1992 Antosko ..... 229/103
5,249,550 A * 10/1993 Hines et al. ..... 229/101
5,632,379 A * 5/1997 Frost ..... 426/115
5,826,781 A * 10/1998 Jensen ..... 229/114
5,875,956 A * 3/1999 Benarrouch ..... 229/938
6,375,066 B1 * 4/2002 Ritter ..... 229/906
7,021,526 B2 * 4/2006 Nishikawa et al. ..... 229/902
7,051,919 B1 * 5/2006 Walsh ..... 229/103
2003/0121961 A1 * 7/2003 Pilgrim et al. ..... 229/906
2004/0217154 A1 * 11/2004 George ..... 229/906
2005/0263576 A1 * 12/2005 Graham et al. ..... 229/938
2007/0221717 A1 * 9/2007 Burke et al. ..... 229/146
2007/0267471 A1 * 11/2007 Falana ..... 229/906
2007/0284422 A1 * 12/2007 Saunders et al. ..... 229/101

* cited by examiner

*Primary Examiner* — Gary Elkins
(74) *Attorney, Agent, or Firm* — George R. McGuire; Bond Schoeneck & King

(57) ABSTRACT

A disposable holder for food that includes a separable component for grasping a food item previously contained within the holder during consumption by a user. The holder has separable upper and lower portions that include corresponding tabs for keeping the holder closed. One of the upper or lower portions includes a series of fold lines, such that the upper or lower portion may be folded around a food item after separated from the other portion.

1 Claim, 6 Drawing Sheets

FOOD CONTAINER

CROSS-REFERENCE TO RELATED APPLICATIONS

The present application claims priority to and incorporates by reference the entirety of U.S. Provisional Application 61/099,071 filed on Sep. 22, 2008.

BACKGROUND OF THE INVENTION

1. Field of the Invention

The present invention relates to packaging for a food item, and, more specifically, to packaging with a removable portion used to hold food while the food is consumed.

2. Description of the Related Art

It is extremely common for food such as sandwiches and hamburgers to be purchased and consumed while operating a vehicle or otherwise mobile. This food often contains sauces, condiments, and other loose components such as lettuce, cheese, tomatoes, pickles, and onions, among others. While this food is designed to be hand-held, spills and drips occur frequently and can distract the consumer from other tasks such as operating the vehicle. Additionally, spilled or dripped food components can soil and stain clothing, upholstery, and other surfaces.

Prior methods to protect against spills, drips, or falling food have involved using an additional device meant to hold the food or shield the consumer. These devices are typically purchased separately from the food and are often neither convenient, disposable, nor recyclable.

SUMMARY OF THE INVENTION

It is therefore a principal object and advantage of the present invention to provide a method for holding food and providing protection from spills and dropped components.

It is another object and advantage of the present invention to provide a food holder that is part of the container in which the food is purchased.

It is another object and advantage of the present invention to provide a convenient food holder that is disposable and recyclable.

In accordance with the foregoing objects and advantages, the present invention provides a food holder that is convenient, inexpensive, disposable, and recyclable. More specifically, a food holder that is a separable component of the packaging in which the food is purchased by the consumer. In one aspect of the present invention, a container for containing a food item therein is provided that comprises a tray, a lid hingedly joined to the tray for selective movement relative thereto between open and closed positions, and further including structure hat permits the permanent separation of the lid from the tray. The lid is structured such that once it is separated from the tray it may be folded about a fold line causing a transformation of its sidewalls to a flexed position, thereby collectively forming a pocket in which the food item may be securely enveloped.

The lid and tray each include a plurality of sidewalls with at least one of each including a locking tab that is adapted to interact with the opposing locking tab to secure the tray in a locked condition when the tray and lid are closed relative to one another.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
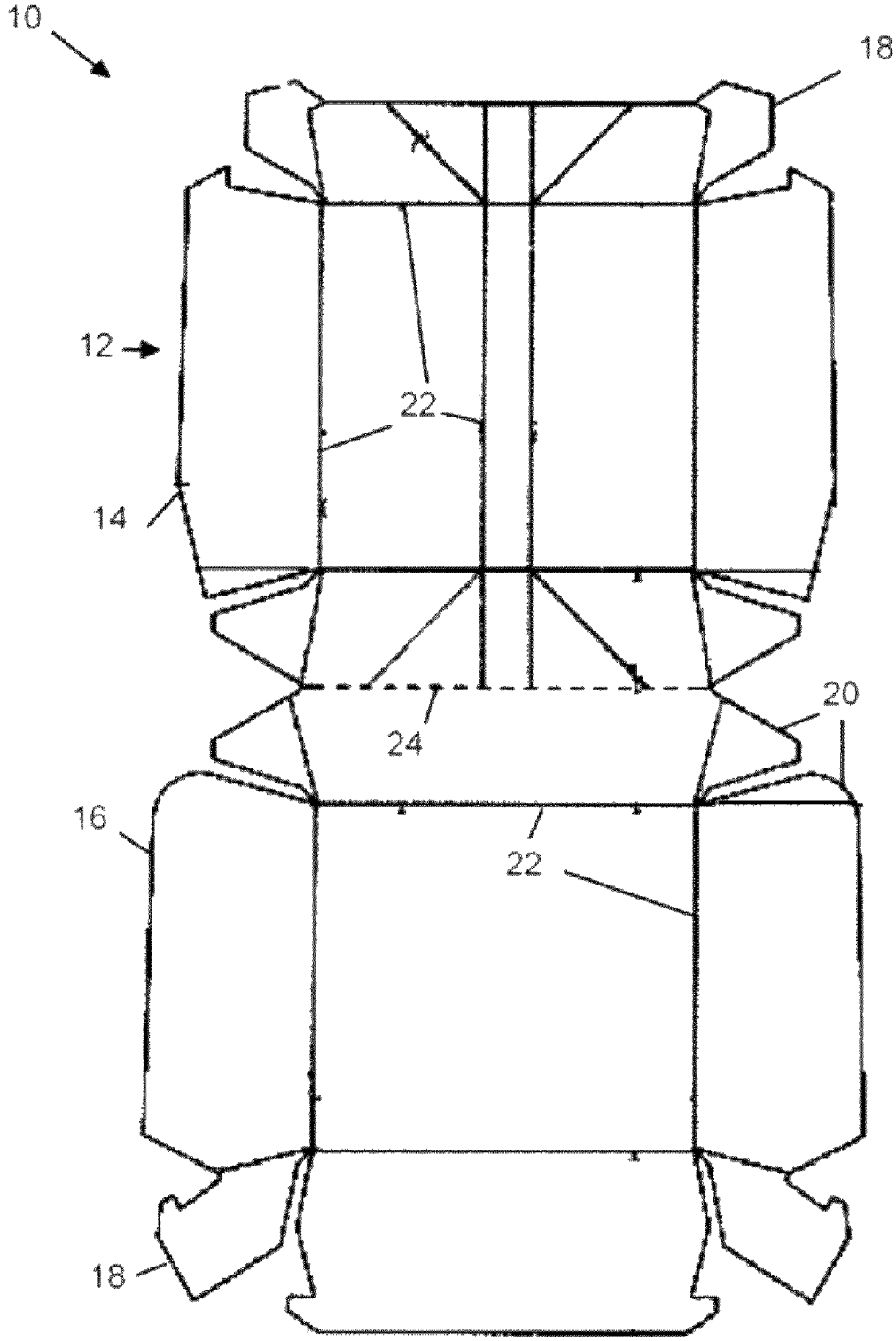
FIG. 1 is a schematic of a food packaging container including a food holder according a first embodiment of the present invention.

Referring now to the drawings, wherein like reference numerals refer to like parts throughout, there is seen in FIG. 1, a first embodiment of a food packaging device 10 including a separable component 12 used for holding food according to the present invention. Device 10 comprises a structure that may be cut from a blank of suitable stock material, such as corrugated paperboard, and folded into the appropriate configuration. In the embodiment seen FIG. 1, device 10 includes upper and lower portions 14 and 16, respectively, having interlocking tabs 18 for retaining device 10 in a user-operable configuration. To assist with the folding of device 10 into a usable configuration, device 10 may include a series of cut lines 20 and creases 22. Device 10 may further include a line of perforations 24 to allow the separation of upper and lower portions 14 and 16, respectively, from each other. It should be recognized by those of skill in the art that any suitable means for forming creases or folds could be uses to encouraging folding along the patterns indicated in FIG. 1.

When upper portion 14 and lower portion 16 of device 10 are connected and device 10 is folded into its usable configuration, those of skill in the art will recognize that device 10 forms a container for housing a food item, such as a hamburger or cheeseburger. Interlocking tabs 18 allow device 10 to be closed around a food item and retained in the closed position until unlocked by a user. When upper portion 14 is separated from lower portion 16 along perforation 24, upper portion 14 may be further folded into a second configuration and used to grasp the food item, as seen in FIG. 1.

Figure 2:
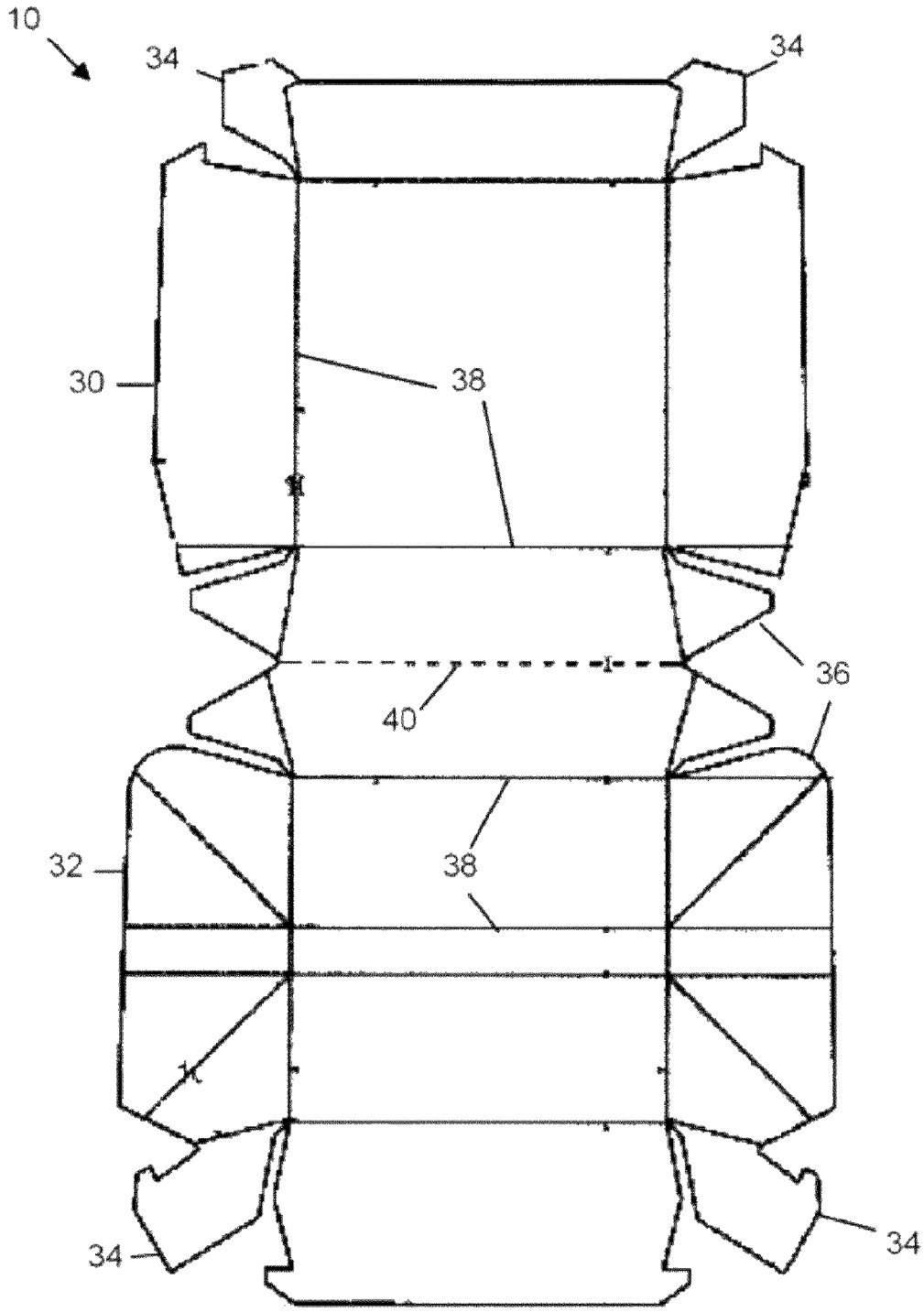
FIG. 2 is a schematic of a food packaging container including a food holder according a second embodiment of the present invention.

Referring to FIG. 2, a second embodiment of device 10 according to the present invention comprises includes upper and lower portions 30 and 32, respectively, having interlocking tabs 34 for retaining device 10 in a user-operable configuration. To assist with the folding of device 10 into a usable configuration, device 10 includes a series of cut lines 36 and creases 38. Device 10 may further include a line of perforations 40 to allow the separation of upper and lower portions 14 and 16, respectively, from each other. It should be recognized by those of skill in the art that any suitable means for forming creases or folds could be uses to encouraging folding along the pattern indicated in FIG. 2.

When upper portion 30 and lower portion 32 of device 10 are connected and device 10 is folded into its usable configuration, those of skill in the art will recognize that device 10 forms a container for housing a food item, such as a hamburger or cheeseburger. Interlocking tabs 34 allow device 10 to be closed around a food item and retained in the closed position until unlocked by a user. When upper portion 30 is separated from lower portion 32 along perforations 40, upper portion 32 may be further folded into a second configuration and used to grasp the food item, as seen in FIG. 2.

Figure 3:
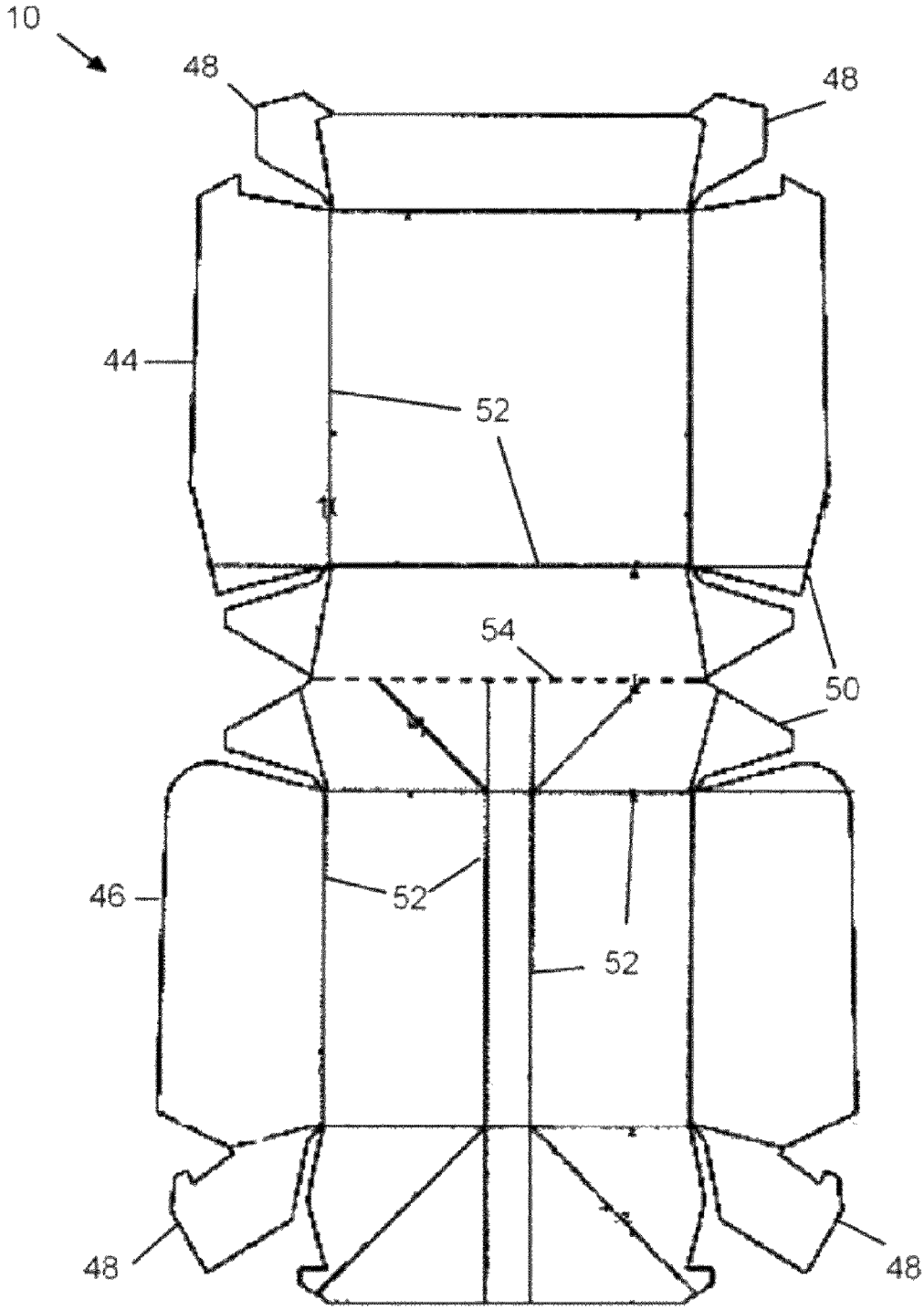
FIG. 3 is a schematic of a food packaging container including a food holder according a third embodiment of the present invention.

Referring to FIG. 3, a third embodiment of device 10 according to the present invention comprises includes upper and lower portions 44 and 46, respectively, having interlocking tabs 48 for retaining device 10 in a user-operable configuration. To assist with the folding of device 10 into a usable configuration, device 10 includes a series of cut lines 50 and creases 52. Device 10 may further include a line of perforations 54 to allow the separation of upper and lower portions 14 and 16, respectively, from each other. It should be recognized by those of skill in the art that any suitable means for forming creases or folds could be uses to encouraging folding along the pattern indicated in FIG. 3.

When upper portion 44 and lower portion 46 of device 10 are connected and device 10 is folded into its usable configuration, those of skill in the art will recognize that device 10 forms a container for housing a food item, such as a hamburger or cheeseburger. Interlocking tabs 48 allow device 10 to be closed around a food item and retained in the closed position until unlocked by a user. When upper portion 44 is separated from lower portion 46 along perforations 54, lower portion 46 may be further folded into a second configuration and used to grasp the food item, as seen in FIG. 3.

Figure 4:
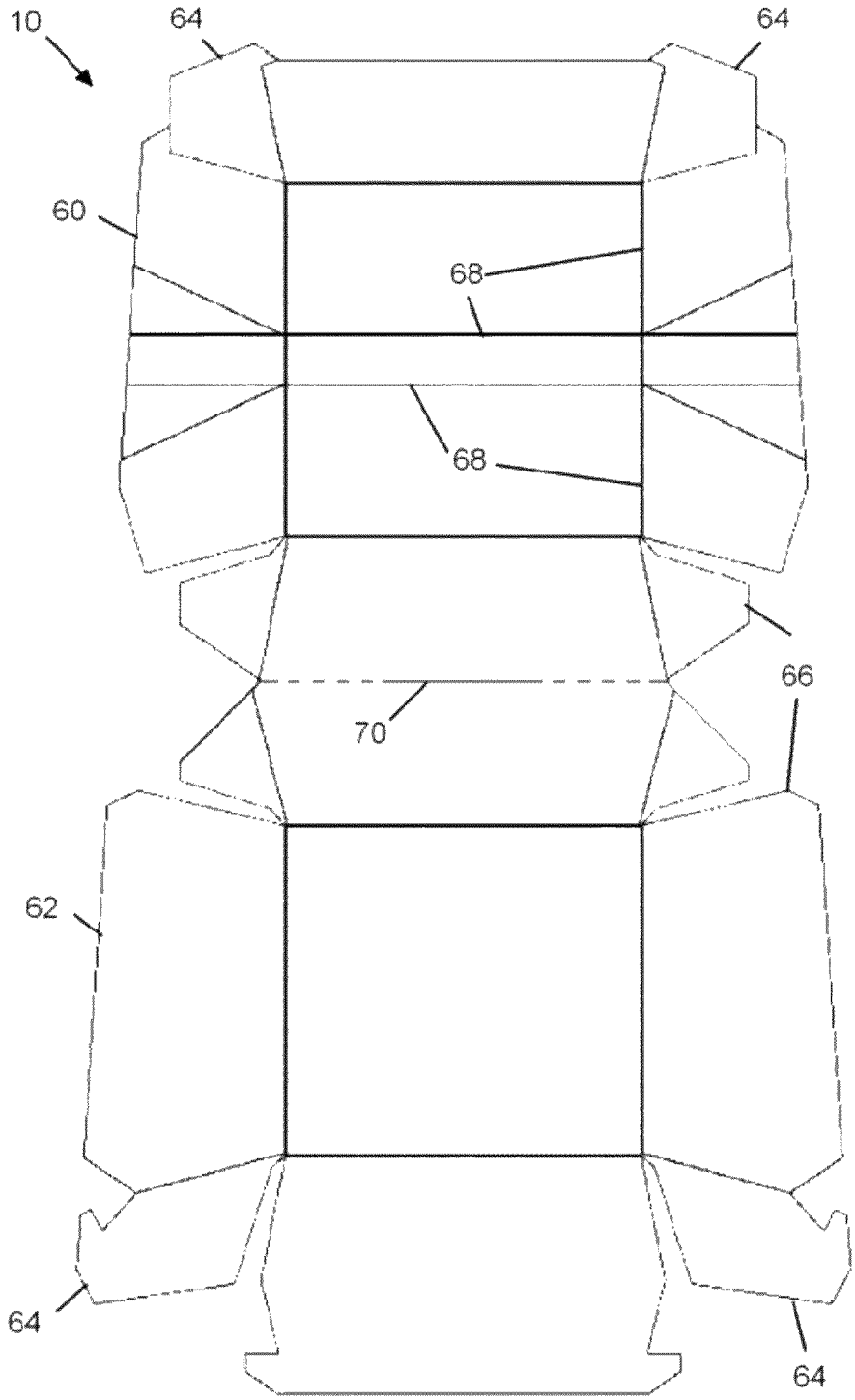
FIG. 4 is a schematic of a food packaging container including a food holder according a fourth embodiment of the present invention.
Figure 5:
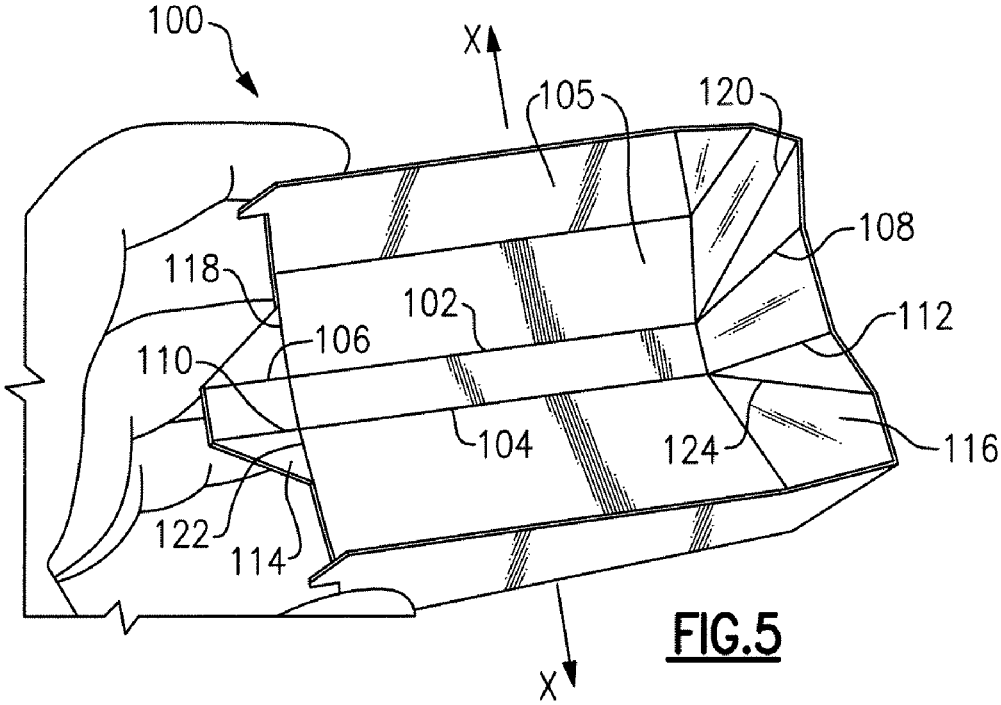
FIGS. 5-8 are perspective views at different angles of the lid portion of the container after it has been separated from the lid and formed into a pocket adapted to at least partially envelope a food item.
Figure 6:
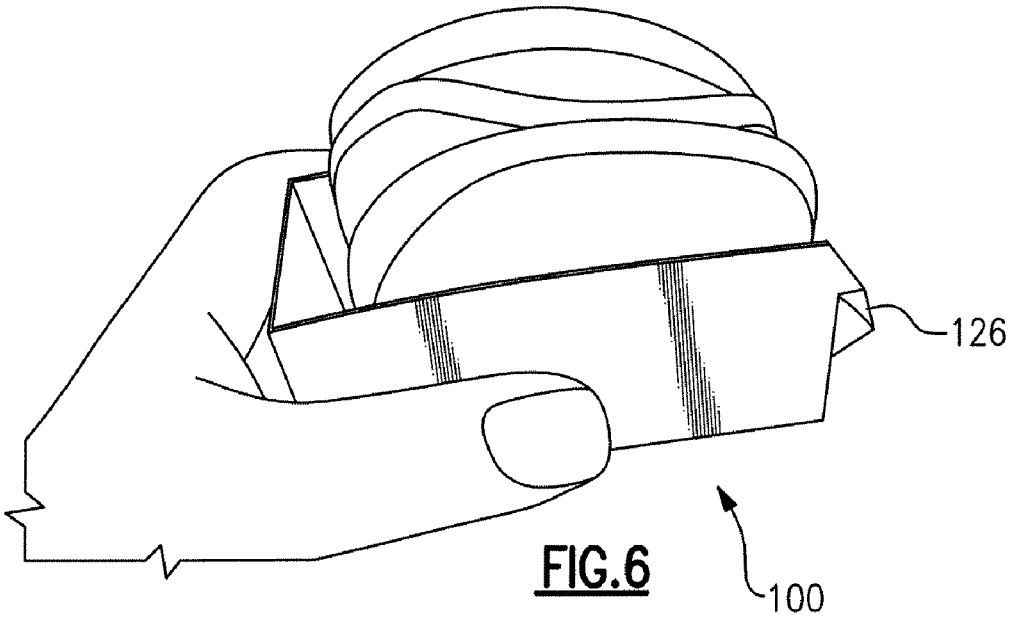
Figure 7:
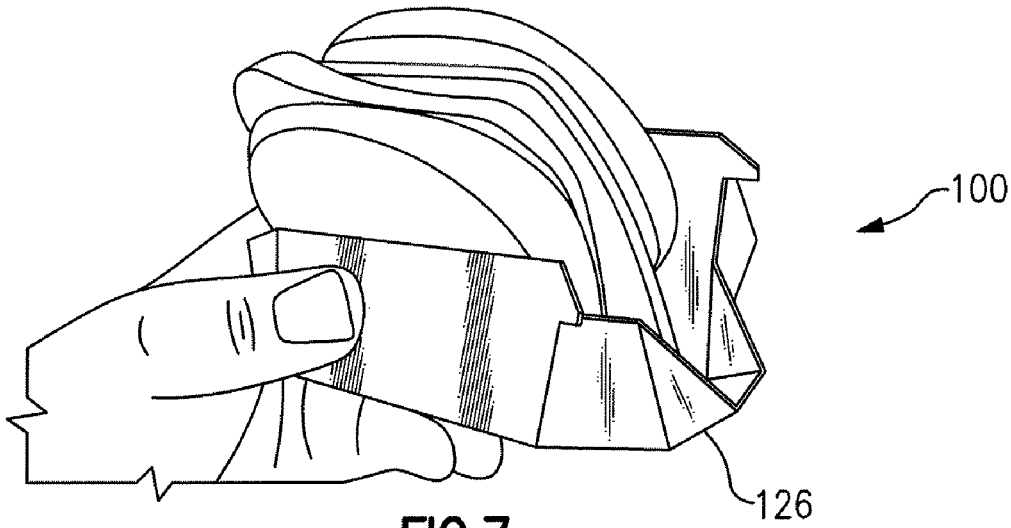
Figure 8:
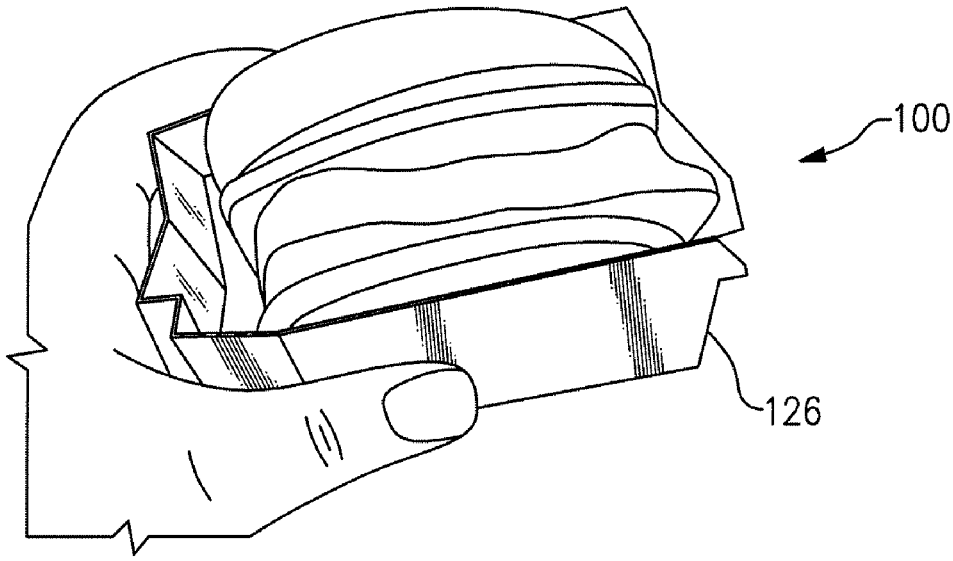

Referring to FIG. 4, a fourth embodiment of device 10 according to the present invention comprises includes upper and lower portions 60 and 62, respectively, having interlocking tabs 64 for retaining device 10 in a user-operable configuration. To assist with the folding of device 10 into a usable configuration, device 10 includes a series of cut lines 66 and creases 68. Device 10 may further include a line of perforations 70 to allow the separation of upper and lower portions 60 and 62, respectively, from each other. It should be recognized by those of skill in the art that any suitable means for forming creases or folds could be uses to encouraging folding along the pattern indicated in FIG. 4.

When upper portion 60 and lower portion 62 of device 10 are connected and device 10 is folded into its usable configuration, those of skill in the art will recognize that device 10 forms a container for housing a food item, such as a hamburger or cheeseburger. Interlocking tabs 64 allow device 10 to be closed around a food item and retained in the closed position until unlocked by a user. When upper portion 60 is separated from lower portion 62 along perforations 70, lower portion 62 may be further folded into a second configuration and used to grasp the food item, as seen in FIG. 4.

With reference to FIGS. 5-8, the upper (or lid) portion of each of the embodiments is generically referred to by reference numeral 100 and is shown after it has been separated from the lower (or tray) portion of the container. Upper portion 100 comprises a pair of scored fold lines 102, 104 formed in major surface 105 and along parallel axes that extend transverse to the longitudinal axis X-X of the lid (it should be noted that the lid could alternatively include just a single fold line, or more than two fold lines). Score lines 106, 108 and 110, 112 are extensions of score lines 102, 104 and are formed in sidewalls 114 and 116, respectively. Further score lines 118, 120 and 122, 124 are formed diagonally from score line extensions 106, 108 and 110, 112 at the intersection of sidewalls 114 and 116 and major surface 105 to the terminal edges of sidewalls 114 and 116. Upon separation of lid 100 from the tray portion of the container, a user can fold major surface 105 about its two fold lines, thereby bringing the two parts of the major surface towards one another, which will cause (perhaps with user intervention) sidewalls 114 and 116 to also bend along the extend score lines 106, 108 and 110, 112 and flex outwardly about their respective diagonal score lines 118, 120 and 122, 124. The collective folding of major surface 102, and bending and flexing of sidewalls 114, 116 collectively define a pocket in which the food item may be at least partially enveloped and used by the user to hold the food item without directly touching it. A potential advantage of the flexing outwardly of sidewalls 114, 116 about the diagonal fold lines 118, 120 and 122, 124 is the formation of a spout 126 that can be used to drain any liquid, such as grease, that may fill the pocket.

What is claimed is:

1. A container for containing a food item therein, comprising:

a tray including a first major surface and a first plurality of walls extending upwardly therefrom, said first major surface and first plurality of walls collectively defining a primary lower cavity in the container, one of said plurality of walls comprising a first engaging means;

a lid hingedly joined to said tray for selective movement between open and closed positions relative thereto, and including a second major surface and a second plurality of walls extending downwardly therefrom, said second major surface and said second plurality of walls collectively defining a primary upper cavity in said container, one of said second plurality of walls comprising a second engaging means adapted to lockingly interact with said first engaging means when the container is in said closed position;

means for separating said lid from said tray; and once said tray is separated from said lid, means for forming a secondary cavity in said tray, whereby the food item is at least partially enveloped within said secondary cavity said means for forming a second cavity allowing said secondary cavity to be held within a hand of a user to grasp said food item while said food item is being consumed.

* * * * *